US006276186B1

(12) United States Patent
Frenken

(10) Patent No.: US 6,276,186 B1
(45) Date of Patent: Aug. 21, 2001

(54) HYDRAULIC PRESSING DEVICE AND METHOD FOR OPERATING THE SAME

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 09/319,908

(22) PCT Filed: Oct. 15, 1998

(86) PCT No.: PCT/EP98/06632

§ 371 Date: Aug. 10, 1999

§ 102(e) Date: Aug. 10, 1999

(87) PCT Pub. No.: WO99/19947

PCT Pub. Date: Apr. 22, 1999

(30) Foreign Application Priority Data

Oct. 15, 1997 (DE) ..... 197 45 483
Jun. 5, 1998 (DE) ..... 198 25 160

(51) Int. Cl.[7] ..... B21D 7/06
(52) U.S. Cl. ..... 72/453.15; 72/416; 29/751
(58) Field of Search ..... 72/453.15, 453.16, 72/416, 412; 29/751

(56) References Cited

U.S. PATENT DOCUMENTS 2,869,407 * 1/1959 Swanson ..... 72/453.16
2,921,438 1/1960 Klingler et al. .
3,030,838 4/1962 Klingler .
3,087,530 4/1963 Reischer et al. .
4,132,107 * 1/1979 Suganuma et al. ..... 72/416
4,226,110 * 10/1980 Suganuma ..... 72/416
5,195,354 3/1993 Yasui et al. .

FOREIGN PATENT DOCUMENTS 7428678 2/1975 (DE) .
7413845 2/1977 (DE) .
3300235A1 7/1983 (DE) .
3713711A1 12/1987 (DE) .
3719442A1 12/1988 (DE) .
3033723 4/1989 (DE) .
3835696A1 4/1990 (DE) .
3937280A1 5/1990 (DE) .
4206439A1 9/1993 (DE) .
29509976 10/1995 (DE) .
19535691 1/1997 (DE) .

* cited by examiner

*Primary Examiner*—David Jones
(74) *Attorney, Agent, or Firm*—Trexler, Bushnell, Giangiorgi, Blackstone & Marr, Ltd.

(57) ABSTRACT

The invention relates to a method for operating a hydraulic pressuring device with a stationary part (26) and a moving part (24), whereby the moving past (24) is moved relative to the stationary part (26) until a predetermined pressure is reached. In order to operate a hydraulic pressuring device of this type, for example a cable shoe (connecting) or riveting tool pressing device, whose handling is especially improved, the invention provides that moving part (24) returns automatically and completely to the initial position thereof when a predetermined pressure is reached.

24 Claims, 6 Drawing Sheets

2
36 34 35 38 30 31 39
37
6
a
25
10
9
9'
20
32
1
29
5
7
4
40
28
3
8
14
13
27
12
33

2
36 34 35 38 30 31 39 37
9'
b
9 10 25
3 28 40 4 7 5 29 1 32 20 6
8 14 13 27 33 12

HYDRAULIC PRESSING DEVICE AND METHOD FOR OPERATING THE SAME

The invention relates in the first place to a method for operating a hydraulic pressing device having a stationary part and a moving part, the moving part being displaced in relation to the stationary part until a predetermined pressure is reached.

Hand-operated or motor-driven hydraulic tools are often employed for certain joining procedures, such as for example the pressing-on of cable eyes onto electrical conductors, or for riveted connections. These tools are provided with an excess pressure valve which limits the oil pressure, and thus the compressive force of the moving part against the workpiece to be pressed, to a maximum value. In order to ensure a well-made joint, e.g. of a cable eye to an electrical conductor, it is known for the excess pressure valve to act only when a prescribed minimum compressive force is reached. This makes sure that the full required compressive force was effective. After release of the excess pressure valve, the pressing device, or rather the moving part thereof, is returned manually to the initial position, i.e. the open position.

Having regard to the above-described state of the art, the invention is addressed to the technical problem of providing a method for operating a hydraulic pressing device of the type under discussion, such as for example a cable eye (connector) pressing device, or a riveting tool pressing device, in which method the handling aspect is especially improved.

This problem is solved in the first place and to a substantial extent by the subject matter of claim 1, it being provided that the moving part returns automatically and completely back into its initial position, released by the predetermined pressure being reached. Accordingly, on achievement of a maximum pressure, there occurs an automatic opening of the pressing device and complete return of the moving part into the initial position. The user is spared having to intervene manually in order to open and return the moving part. The user is simultaneously given an optical signal also, by the return movement of the moving part, that the joint has been properly made with the prescribed maximum pressure.

The invention relates moreover to a method for operating a hydraulic pressing device, such as for example a pipe clamping tool, that has a stationary part and a moving part and an automatically actuating return valve, the moving part being biased into its initial position by means of a return spring. In this type of hydraulic pressing device, especially a pipe clamping tool, it is known for the return stroke of the hydraulic piston to take place automatically once the switch-off pressure has been reached. Only for emergencies is an additional, manually operated, return valve provided. In normal operation, the pressing or the joint formation can only be ended after the maximum pressure has been exceeded and the tool opens by the automatically returning hydraulic piston which carries the moving part with it. Known constructional solutions of the desired manner of operation consist of using an excess pressure valve which, after release, is arrested by a mechanical stop mechanism and thus permits complete return travel of the spring-loaded piston. On renewed actuation of the pressing device, for example when the motor is switched on, the arresting is mechanically disconnected and the excess pressure valve falls back into the closed position. In order to provide a hydraulic pressing device of the general type here under discussion, such as for example a pipe clamping device, which is characterised in particular by an advantageous arrangement from the handling aspect, it is provided that the return valve is held open by the force of the return spring, and returns automatically to its initial closed position after removal of the restoring force. As a result of this method according to the invention, no mechanical components are required for arrest of the piston or the moving part in the initial position, which furthermore obviates structural solutions for disconnecting the arresting when the pressing device is in use. In the method according to the invention, the restoring force, which is present anyway, of the return spring, is advantageously used for returning the moving part, so as to keep the return valve open over the entire return stroke of the moving part. No further arrest means are needed. After completion of the return movement, there is no further hydraulic pressure, owing to a limiting abutment of the spring-biased hydraulic piston, which results automatically in a return displacement of the return valve into the initial, closed position. The limiting abutment of the hydraulic piston also gives rise, shortly before an end position, to the smallest hydraulic pressure effective to keep the return valve open.

The invention relates further to a hydraulic pressing device with a stationary part and a moving part, the moving part being displaced relative to the stationary part by a hydraulic piston and being movable back to an initial position by means of a return spring, the return displacement being releasable in dependence on a predetermined pressure by actuation of a return valve. In order to provide a hydraulic pressing device of the kind under discussion with improved functional reliability and handling properties, it is proposed that the automatically acting return valve be retained in the open position, throughout the entire return stroke of the hydraulic piston, by the pressure of the returning oil. Mechanical arrest of the return valve during the return stroke of the hydraulic piston or of the moving part can be dispensed with by means of this arrangement, which offers special advantages in operation. Known structural solutions consist, for example, in the use of an excess pressure valve which, after actuation, is arrested by a mechanical stop mechanism and thus makes possible a full reverse stroke of the spring-loaded piston. On a fresh actuation of the pressing tool, for example by switching the motor on, the arresting is mechanically disconnected and the excess pressure valve goes back into the closed condition. But in accordance with the invention, the pressure of the returning oil, which is present anyway, after actuation of the return valve, is used for maintaining the return valve in the open position. The return valve acts automatically when a predetermined oil pressure is exceeded. The pressure of the returning oil, which decreases during the return of the hydraulic piston, is sufficiently high over the entire return stroke to keep the return valve in the open condition. It is found especially advantageous in this connection for the return valve to be formed as a valve piston, a partial piston surface area, effective in the closed condition, being calculated having regard to the maximum pressure. To this end, the return valve consists for preference of a valve piston having for example a needle point which closes off a bore connecting with the pressure space. The smaller partial piston surface effective by reason of the bore diameter is engaged by the oil in the course of pressing by the hydraulic pressing device. If the oil pressure exceeds a value predefined by the bore diameter, the valve piston of the return valve is raised from its sealing seat by way of the partial piston surface, whereupon a substantially greater piston area comes into effect. The return valve in this position operates with a substantially lower limiting pressure than in the closed condition. The limiting pressure in this position is no longer defined by the smaller partial piston surface area, but rather by the total surface area of the valve piston, formed, as it is, as a longitudinally sliding piston. As an example, a ratio of 400:1 can exist between the total piston area and a smaller, partial piston surface area which co-operates with the sealing seat. In consequence, the limiting pressure in the open position of the valve piston is 400 times smaller than the actuation pressure in the seated position, i.e. in the initial closed condition. As a result of this arrangement, a return valve is provided which has high hysteresis, so that the valve piston remains in the open position throughout the entire return stroke of the hydraulic piston because of the oil pressure acting on the valve piston, despite the fact that the oil pressure continuously diminishes in the course of the return displacement. The valve piston only falls back into the initial closed position when the oil pressure falls below a prescribed minimum. This very low oil pressure equates to the fully returned position of the hydraulic piston. In an exemplary embodiment, actuation, i.e. the opening of the return valve, can occur at 600 bar, and automatic return travel thereof into the initial position at 1.5 bar. In a hydraulic pressing device of the kind under discussion, in which the return valve is biased into the closed position by means of a compression spring, it is provided furthermore that the cylinder in which the valve piston is accommodated, has a discharge port to an oil reservoir, and that the discharge port is opened in the course of a displacement of the valve piston into the open position. By this arrangement according to the invention, when the actuation pressure, defined by the force of the compression spring and the smaller, partial piston surface area, has been exceeded, the oil does not flow away directly into the oil reservoir. Rather the oil reaches the oil reservoir only through the discharge port, and the discharge port is not opened until the valve piston has been displaced to a overlapping extent. The valve piston, to this end, can be fitted without much play, so that relatively little oil can escape by flowing past it. In order to give the return valve controllable damping, it is provided in an advantageous development of the invention that a relief bore is provided to the rear of the valve piston, the bore penetrating the cylinder wall. This bore serves for pressure relief of the space behind the piston, and the damping of the valve can be controlled by way of the size and situation of the relief bore. The desired automatic return of the hydraulic piston is made possible, in simply-acting cylinders having a return spring, by making this return spring of such dimensions that by pressing on the hydraulic piston, it creates an oil pressure which lies above the limiting pressure of the return valve in its longitudinal sliding condition. By this means, the valve is held open and the hydraulic piston returned. The arrangement of the return spring is preferably such that the hydraulic piston returns all the way to an abutment stop. In this end position, the return flow ceases and the valve piston descends into its initial position, the seated position, after which the hydraulic pressing device is ready for the next working cycle. As an example, a target maximum pressure of 600 bar in the pressure space may be desired. If this is exceeded, the return valve is actuated and the limiting pressure sinks to about 1.5 bar. The rating of the return spring is, for instance, such that the pressure in the pressure space is always 2.5 bar during the return stroke of the hydraulic piston. The pressure difference of at least 1 bar is mainly absorbed as a throttle loss in the flow through the small bore of the sealing seat, which bore co-operates, in the closed position, with the smaller, partial piston surface; this pressure difference determines the throughflow of oil and thereby the return velocity of the hydraulic piston. One advantage of the return valve described is that along with the excess pressure valve, which has to be provided anyway, no additional parts, such as for example mechanical latching elements, are necessary. Moreover the valve goes automatically, without necessity for manual unlatching, back to its initial state. In a further embodiment, it is provided that the valve piston can be displaced into an open position by hand. Such hand operation is desired for instance for interrupting the pressing procedure. To this end, the valve piston is moved into an open position, whereby the discharge port to the oil reservoir is opened. This results in a fall in the oil pressure and thereby a return displacement of the hydraulic piston. A pulling part is furthermore of advantage, connected to the valve piston and passing through the cylinder. This pulling part, in a preferred embodiment, is movable by hand, by means of an actuating rocker. This actuating rocker constitutes for the user an advantageous lever arm, by means of which the valve piston can be lifted up from the valve seating against the force of the compression spring which acts on the seating. This arrangement in accordance with the invention ensures at all times a manual return stroke of the hydraulic piston, necessary in emergencies. In a further embodiment, it is provided that the valve piston is pot-shaped on its rear side relative to the surface of the valve piston which is exposed to pressure. It is furthermore proposed that the pulling part comprises a drive head, which is in engagement with a drive nose on the valve piston. On tripping the actuating rocker, the valve piston is accordingly displaced away from the valve seating by means of the pulling part which has the drive head. The compression spring, which co-operates in defining the actuation pressure, can here bear directly on the pot-shaped valve piston. An embodiment is preferred, however, in which the compression spring acts on the valve piston by way of the pulling part. A further advantage, especially in assembly or repair operations, arises from the drive nose being a spring washer disposed in the pot wall of the valve piston. An alternative provision has the drive nose integrally formed as a radial collar on the pot wall of the valve piston, preferably the inner wall thereof, the collar acting at the same time to centre the pulling part within the valve piston. Furthermore, the bore which co-operates with the smaller piston surface of the valve piston can be provided in a seating disc screwed-in into the cylinder. Resulting from this arrangement, it is possible in very simple manner to change the seating disc and the valve piston, the piston being associated with the pulling part by way of the spring washer. A further possibility is for the other end of the compression spring which acts on the valve piston to be supported against a screw, by which the desired preloading of the compression spring can be adjusted. Adjustment of the limiting pressure is thereby enabled. It is provided in addition that the drive head is formed as a circumferential flange on the cylindrical pulling part. It proves advantageous, moreover, especially with a view to a high functional reliability, for the pulling part to act on the valve piston by way of a spigot portion of reduced diameter located at the centre of the drive head. By these means, in very simple manner, there is achieved a moment-free transfer of force from the pulling part to the valve piston. Alternatively or in combination with the above-described embodiments, it can also be provided that the drive head, in the open condition of the return valve, defines an active piston surface. From this, it follows that the oil flowing in, after the valve is opened, acts directly on the pulling part, the drive head of the pulling part thus constituting the piston surface or at least a part thereof. Here it is preferred that the drive head, in the open condition of the return valve, constitutes a partial piston surface integrated into the active valve piston surface of the valve piston. As a result of this arrangement, the drive head, or the active piston surface thereof, is an integral component of the total piston surface, it being preferred furthermore that the valve piston surface, which is now formed to be annular, is flush with the piston surface of the drive head, at least in the operating condition. In this connection, an arrangement is preferred in which the valve piston is a hollow cylinder having a circular cross-section, the resulting annular front surface constituting the valve piston surface. It is provided in a further variation of this embodiment that the drive head provides, in the closed condition, a partial piston surface, the area of which is calculated with reference to the desired maximum pressure. To this end, the drive head is preferably equipped with a closure member, e.g. a needle point, which closes off a bore communicating with the pressure space. If the oil pressure exceeds a value predefined by the bore diameter, the drive head of the pulling part, and with it the valve piston, are lifted from the sealing seat by the partial piston surface formed by the needle point, whereupon the substantially greater piston surface provided by the valve piston and the drive head comes into action. It is furthermore proposed that the diameter of the discharge port be smaller than the height of a closed circumference of the valve piston. For preference in this connection, the diameter of the discharge port is smaller than the height of a closed circumference of the valve piston which faces the valve piston surface, so that the discharge port is initially opened to the extent of a crack and that only after the valve piston is first lifted. It is additionally proposed that, to the rear of the valve piston surface, an annular groove, open to the outer pot sleeve, be provided. This groove stands preferably at least partly in communication with the discharge port in the closed condition of the valve. The arrangement is chosen in such a way that, with raising of the valve piston, there occurs opening of the discharge port for outflow of the oil, while at the same time the open annular groove is cut off from the discharge port. This is achieved by making the distance between the valve piston surface and the annular groove greater than the diameter of the discharge port. A further provision is that an axially aligned flow passage extends from the valve piston surface, to connect the valve piston surface with the annular groove. This flow passage serves in the first place to permit outflow of the unavoidable oil residues in the stationary, closed operating condition, without the prior occurrence thereby of a pressure rise in the remaining gap. In the second place, the flow passage is kept so small that when the valve is opened, displacement of the piston takes place, since in that way the outflowing oil likewise leads to a closure of the flow passage, because of the quantity. In this, there proves to be a significant advantage in that, by reason of the connection of the valve piston surfaces with the rearwardly disposed annular groove which takes up residual quantities of oil, the oil pressure in the course of the valve closing procedure drops off rapidly, which leads in consequence to a more rapid closing of the valve. In this connection, it is further provided that the diameter of the flow passage is smaller than the diameter of an oil inlet bore of the valve. It is also proposed that the annular groove be formed in the outer wall of the pot, for a substantially horizontal disposition of the cylinder bore. An alternative proposal is that the annular groove is formed in the cylinder bore, and that the valve piston has an associated, radial bore. The latter is in communication with the valve piston surface by way of the axially aligned flow passage. The annular groove formed in the bore of the cylinder is for preference provided at the level of the discharge port. Furthermore, it is conceivable for both the cylinder bore and the exterior wall of the pot to be each equipped with a respective annular groove for the uptake of oil residues.

As an alternative or in combination, it is also conceivable to permit only partial return travel of the hydraulic piston. In this case, the rating of the return spring is such that its force in a particular position within the working stroke of the hydraulic cylinder is no longer sufficient to keep the return valve open.

The invention is described in greater detail below, with reference to the accompanying drawing, which illustrates exemplary embodiments only, and in which.

Figure 8:
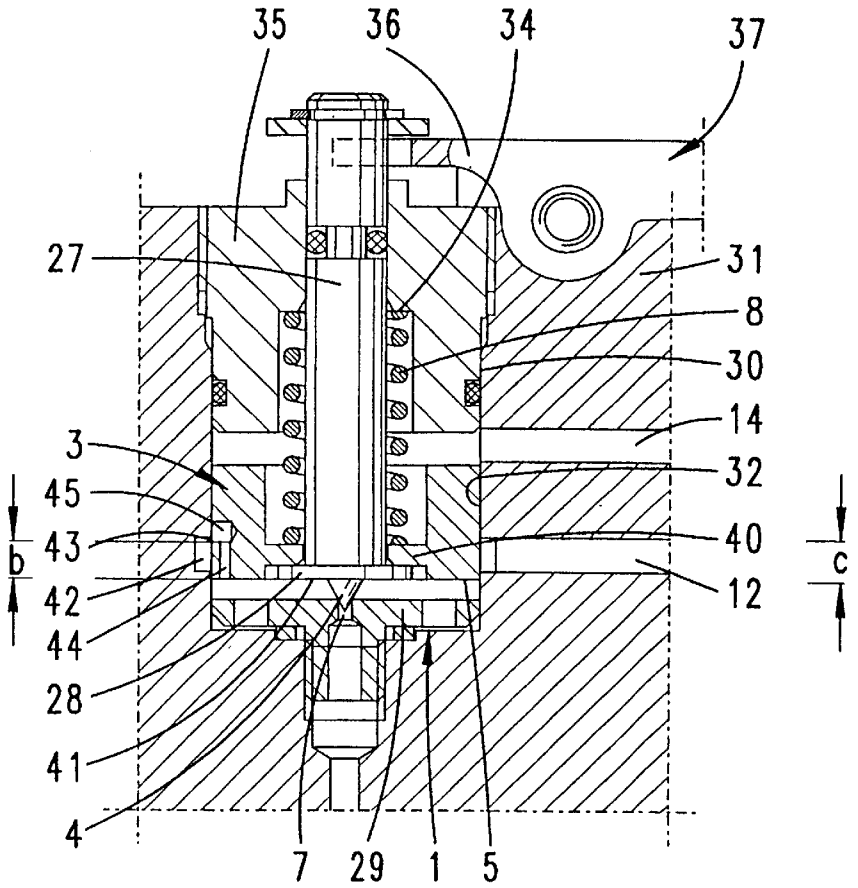
Figure 7:
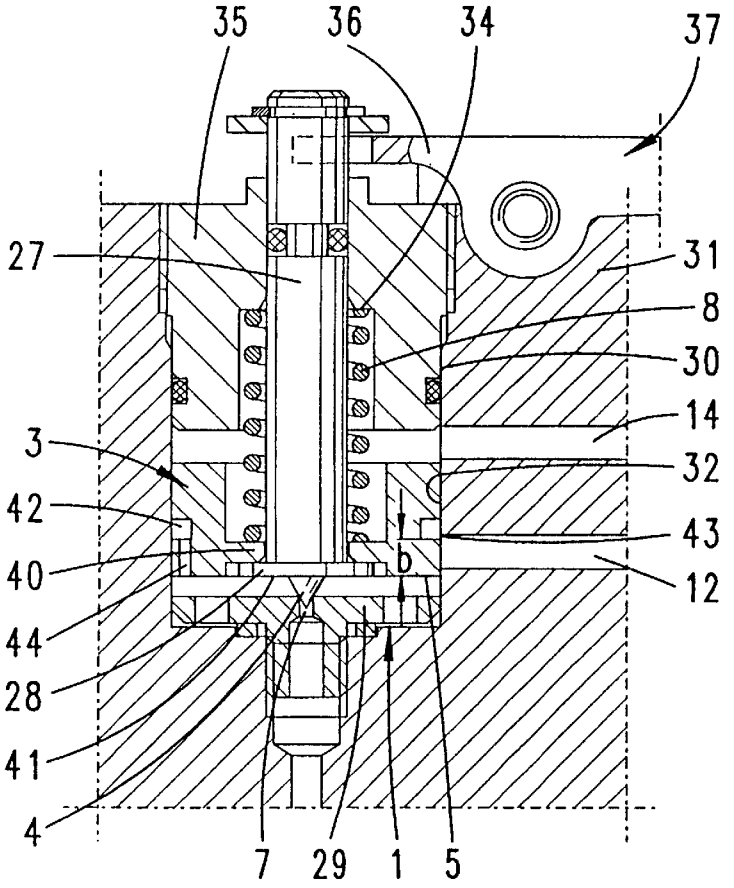
FIG. 7 shows a sectional detail view of a return valve in a further embodiment.

FIG. 8 shows a view corresponding to FIG. 7, but relating to a further embodiment of the return valve First with reference to FIG. 1, there is illustrated and described a return valve 1, e.g. for a hydraulic pressing device 2. This return valve 1 can find application in either hand-operated or motor-driven hydraulic tools.

Figure 1:
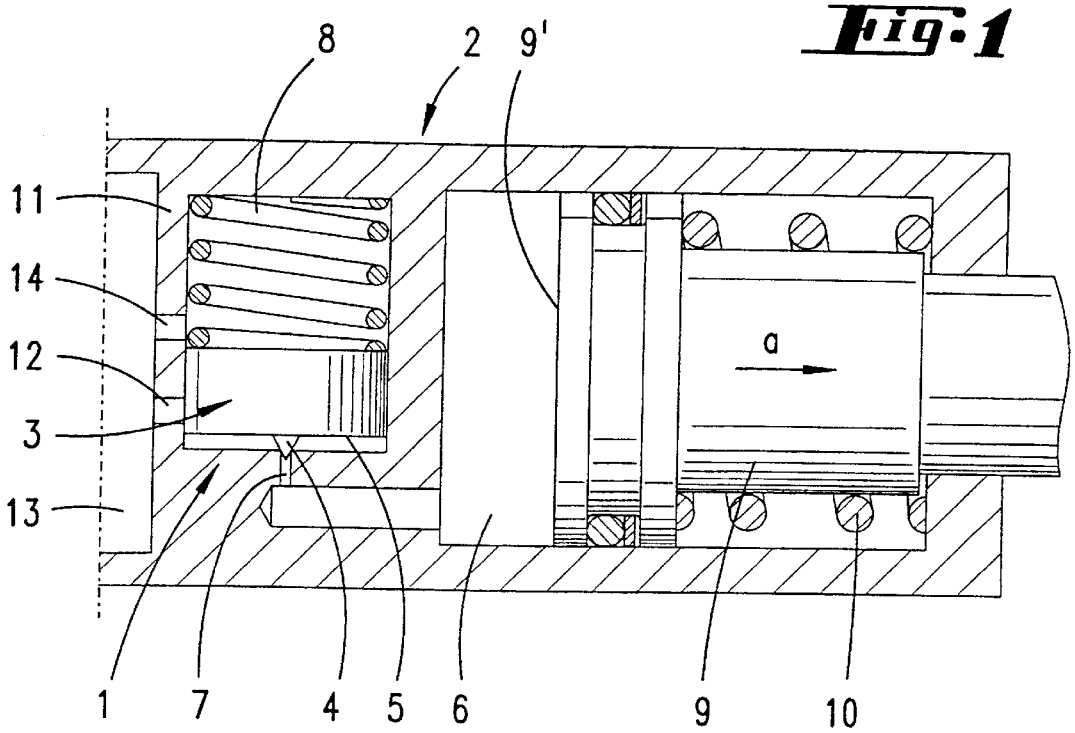
FIG. 1 shows a schematic sectional view of a pressing device according to the invention, equipped with a return valve, in the course of a pressing operation.

The return valve 1 consists essentially of a valve piston 3 with a needle point 4, centrally disposed at the front end and tapering to a point, to form a partial piston surface (effective valve seating surface) substantially smaller than the total piston surface 5 and defined by the diameter of a bore 7 communicating with a pressure space 6. The bore 7 is closed off by the needle point 4 in an initial closed condition as illustrated in FIG. 1.

To its rear, the valve piston 3 is acted on by a compression spring 8, whereby the needle point 4 is pressed against the bore 7 with a force which contributes to the determination of a maximum release pressure. In this way, there is substantially provided a pressure-limiting valve of the seating constructional type.

In order to actuate the pressing device 2, for example to press cable eyes or connectors onto electrical conductors, or also for rivet connection or pipe pressing, oil is pumped into the pressure space 6 by hand or motor power. The resulting rise in oil pressure displaces a hydraulic piston 9 disposed in the pressure space 6 against the force of a return spring 10 in the direction of the workpiece to be pressed (see arrow a in FIG. 1).

In order to assure a proper connection, actuation of the return valve 1 is aimed at in every pressing, thereby guaranteeing that the full pressing force was effective. Thus it is provided, for example, that with a maximum pressure of 600 bar acting on the hydraulic piston surface 9', the return valve 1 opens. This maximum pressure is defined by the very small partial piston surface of the needle point 4, projected onto the bore 7, or for that matter by the cross-sectional area of the bore 7 and by the pressing force of the compression spring 8 on the valve piston 3.

Now if the oil pressure exceeds the predefined maximum value of for example 600 bar, the valve piston 3 is displaced out of its sealing seating on the bore 7 against the force of the compression spring 8, and then, all at once, a substantially greater piston surface area, namely the entire piston surface 5 of the valve piston 3, comes into action. By virtue of the rearward displacement of the valve piston 3, a discharge port 12 provided in the cylinder 11 which accommodates the valve piston 3 is at least partially uncovered, for the return flow of the oil into the oil reservoir 13 (see arrow x in FIG. 2). The valve piston 3 can be fitted in with little play, so that relatively little oil can flow away past it through a relief port 14 into the oil reservoir 13.

Figure 2:
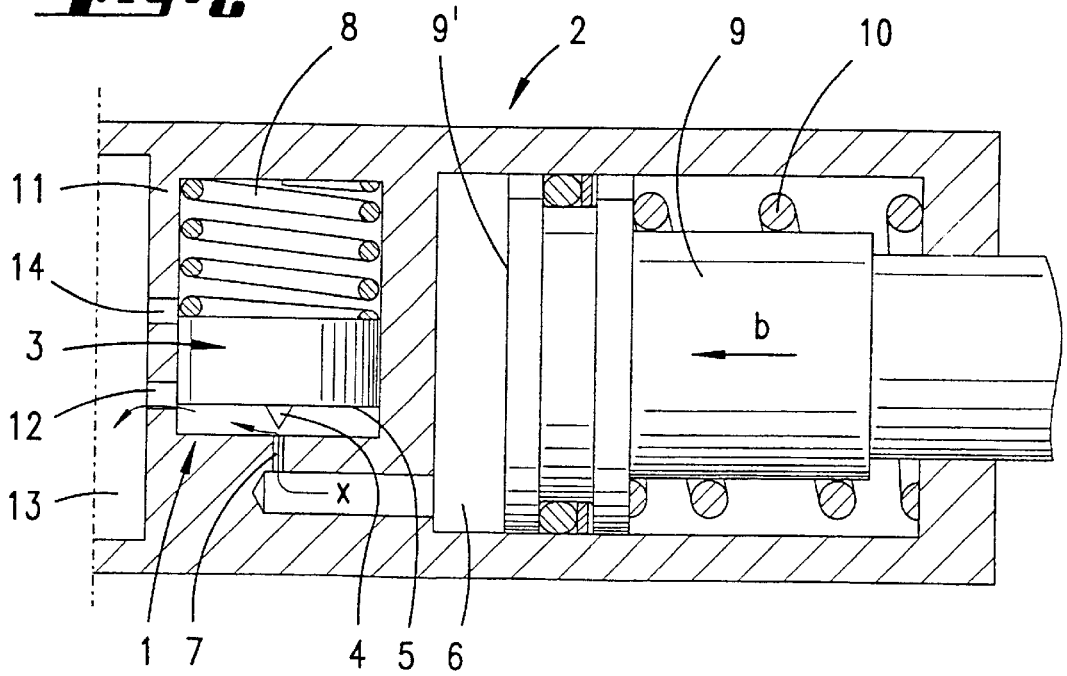
FIG. 2 shows a view corresponding to FIG. 1, but in the course of a return stroke of a hydraulic piston of the pressing device.

In this position, illustrated in FIG. 2, otherwise the longitudinal slide valve position, the return valve 1 again functions as a pressure limiting valve, but now in the longitudinal slide valve constructional mode with a substantially lower limiting pressure, since the latter is now here defined by the substantially greater piston area of the valve piston 3. Accordingly, in the exemplary embodiment shown, a diameter ratio of 1:400 exists between the smaller effective partial piston surface (needle point 4 in bore 7) and the total piston surface area 5, which has the result that the limiting pressure in the open position of the valve according to FIG. 2 is 400 times less than the release pressure.

At the rear of the valve piston 3, moreover, there is provided the relief bore 14 already mentioned, which passes through the wall of the cylinder 11 in the direction of the oil reservoir 13. The bore 14 serves for the relief of pressure on the rear side of the piston. What is more, the damping of the return valve 1 can be influenced by the size and position of the bore 14.

A desired automatic return stroke of the hydraulic piston 9 is made possible through the agency of the return spring 10, in that the spring is so dimensioned that by bearing on the hydraulic piston 9, it produces an oil pressure in the pressure space 6, which pressure is above the limiting pressure of the return valve 1 in its longitudinal slide valve position according to FIG. 2. By this means, the return valve 1 is kept open and the hydraulic piston 9 reversed (see arrow b in FIG. 2).

As a rule, the rating of the return spring 10 is such that the hydraulic piston 9 moves completely back to the stop. In this end position, the return flow of oil ceases, which effects a descent of the valve piston 3 into its initial closed position. The pressing device 2 is then ready for the next operating cycle without further mechanical preparations, such as for example the disconnecting of a mechanical arresting arrangement.

It is also possible to let the hydraulic piston 9 return only part of a stroke. For this, the rating of the return spring 10 is such that, at a predetermined position within the working stroke of the hydraulic piston 9, its force is no longer sufficient to keep the return valve open.

In the embodiment shown, a limitation of the oil pressure in the pressure space 6 to 600 bar is desired. If this is exceeded, the return valve 1 acts, and the limiting pressure drops to about 1.5 bar, because of the ratio of the areas, 1:400, of the piston surfaces one to the other. The rating of the return spring 10 here is such that the pressure in the pressure space 6 always has a value of at least 2.5 bar during the return stroke of the hydraulic piston 10. The pressure difference of at least 1 bar is mainly taken up as a throttle loss in the flow through the small bore 7; it determines the oil throughput and thereby the velocity of the return stroke of the hydraulic piston 9.

The advantage of this kind of return valve 1 is that, apart from the excess pressure valve which has to be provided anyway, no additional parts, such as for example mechanical latching elements, are needed. In addition, the valve 1 returns automatically to its initial condition again, without manual unlatching being necessary, following a dip below the limiting pressure that holds the valve piston 3 open, as in FIG. 1.

Figure 3:
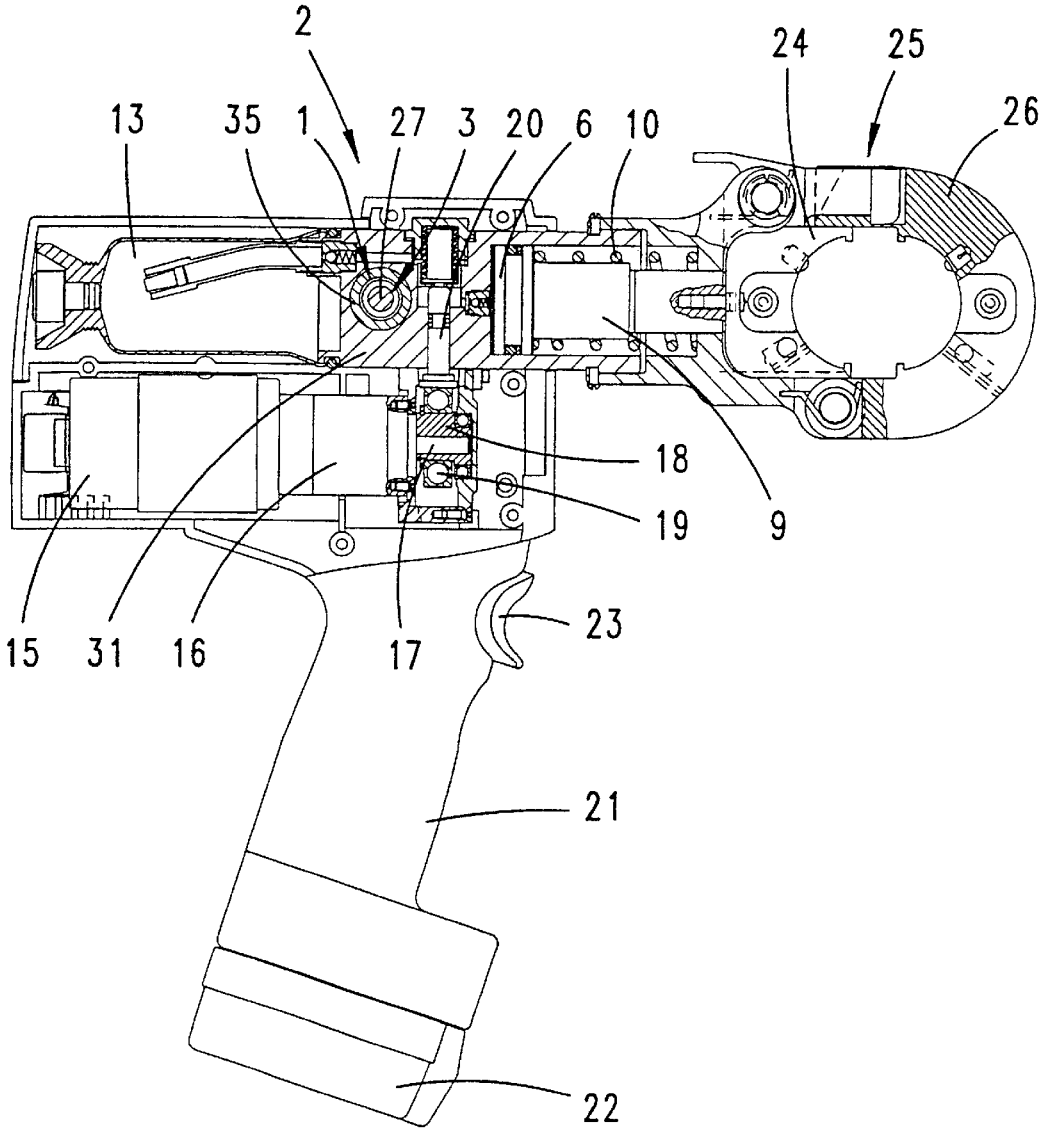
FIG. 3 shows a schematic cross-sectional view of a motor-driven driven hydraulic pressing device, in the initial position.
Figure 4:
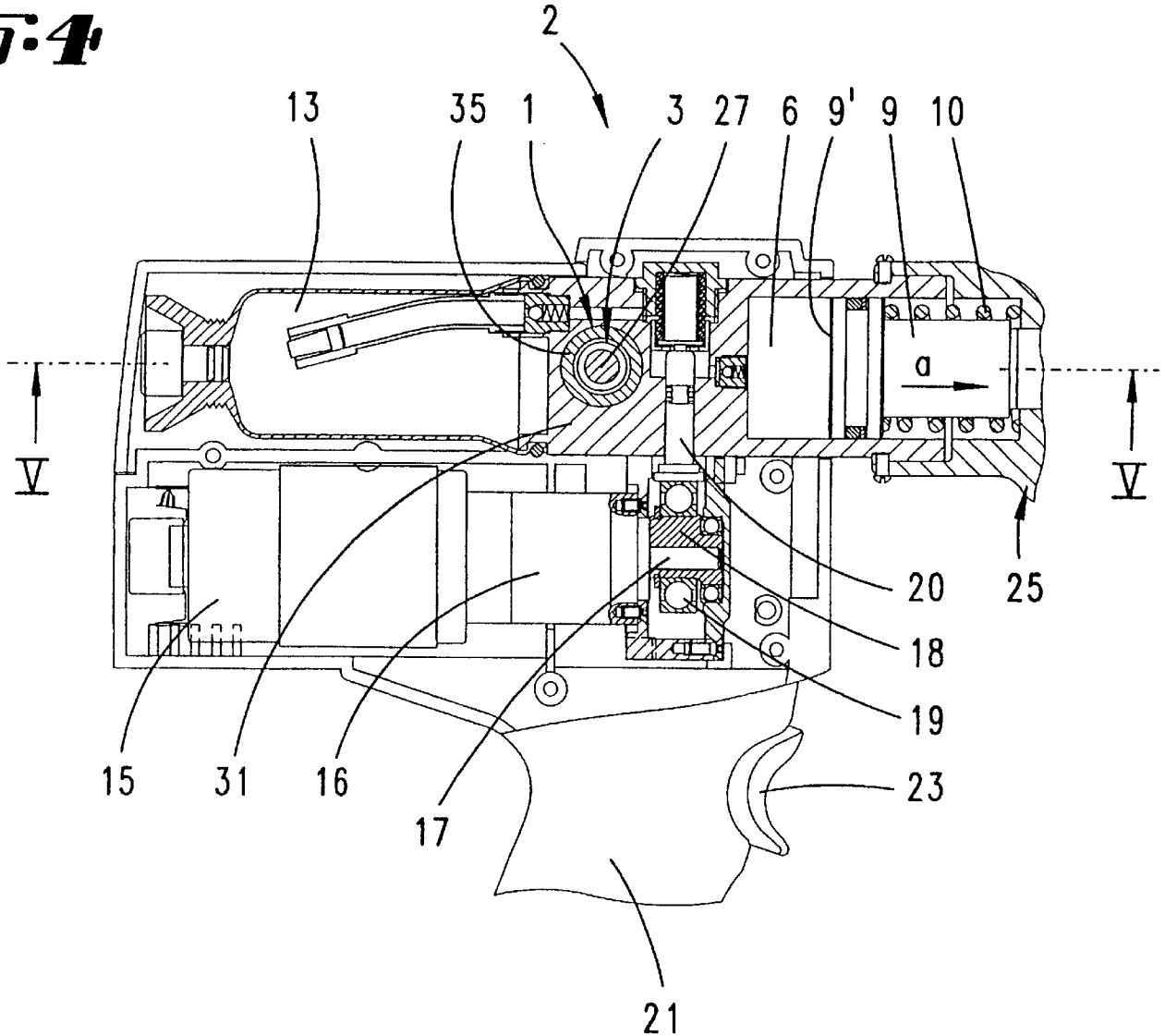
FIG. 4 shows an enlarged cross-section from FIG. 3, but in the course of a pressing operation.

In FIG. 3, an electric motor-driven hand pressing device 2 is illustrated, with a return valve as previously described. A pressing device 2 of this type is known, for example, from the German Patent Application having the File Number 197 31 054, not previously published. The content of this patent application is hereby incorporated as to its full content into the disclosure of the present invention, also for the purpose of incorporating features of this patent application in claims of the present invention.

In this pressing device 2, an electric motor 15 is provided, which has a step-down gearbox 16. The latter, through a shaft 17, drives an eccentric 18, which in turn, by way of a roller bearing 19, acts on a high-pressure delivery piston 20.

The drive of the electric motor 15 is effected by a battery, or by an accumulator 22 integrated in a handle 21.

When a finger-actuatable switch 23 is actuated, oil is pumped from the oil reservoir 13 into the pressure space 6. By this means, the hydraulic piston 9 is displaced in the direction of its end working position, against the action of its return spring 10, taking with it a moving part 24 of the head 25 of a pressing device. The head further comprises a stationary part 26, relative to which the moving part 24 can move.

The return stroke of the hydraulic piston 9 takes place by virtue of the return spring 10, as soon as the return valve 1 opens by reason of the predetermined maximum pressure being exceeded—as described previously.

In this exemplary embodiment, the rear of the valve piston 3 of the return valve 1 is formed to be pot-shaped, i.e. facing away from its piston surface 5. A pulling part 27, aligned axially with respect to the valve piston 3, protrudes into the pot interior, with a drive head 28 which is formed by a circumferential flange on the cylindrical pulling part 27. In contrast to the previously described exemplary embodiment, the bore 7 which co-operates with the needle point 4 of the valve piston 3 is not provided directly in the housing of the device but in a screwed-in seating disc 29. This has advantages, especially in regard to manufacture. Further, the sealing seat can thus also be replaced in very simple manner when required.

Valve piston 3 and seating disc 29 are disposed in a transverse bore 30 in the pump cylinder 31 and centred thereby. In order to hold the valve piston 3 in a positively-locked manner on the pulling part 27, an expanding ring 33 is disposed within the pot wall 32 to the rear of the drive head 28. The compression spring 8 acts on the valve piston 3 in the direction of the seating disc 29 by way of the pulling part 27 in the region of a spigot portion 40 of reduced diameter centrally disposed on the drive head 28. A moment-free transfer of force from the pulling part 27 to the valve piston 3 is effected in very simple manner by the loading of the valve piston 3 through the small spigot portion 40.

At its other end, the compression spring 8 is supported on a base 34 of a likewise pot-shaped threaded body 35 which is screwed into the bore 30.

The body 35 is axially penetrated by the pulling part 27; at the free end of the pulling part 27 which projects from the pump cylinder 31, a lever arm 36 of an actuating rocker 37 is hingedly connected. The rocker 37 is supported on the external surface of the pump cylinder 31 approximately midway along the length of the rocker by a curved portion 38 of part arcuate shape in cross-section and the rocker defines at its free end an outwardly directed actuating key 39.

Figure 5:
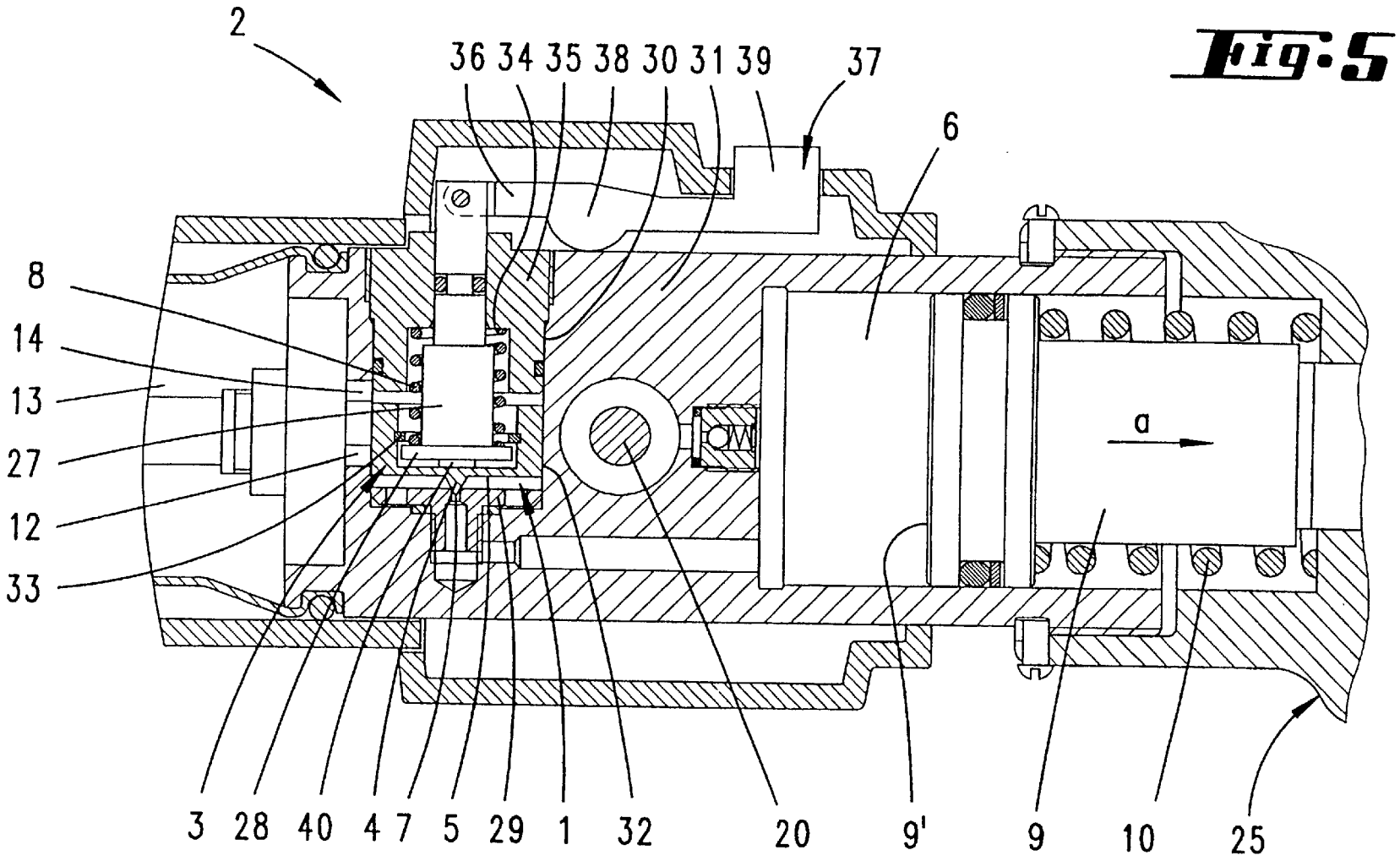
FIG. 5 shows a section taken along the line V—V in FIG. 4.

In an initial, closed condition of the return valve 1, as shown in FIG. 5, the opening 7 is closed off by the needle point 4 of the valve piston 3. In this position, moreover, the discharge port 12, which is directed to the oil reservoir 13, is covered over by the pot wall 32 of the valve piston 3.

The piston 3 in this initial, closed condition, is at an axial spacing from the threaded body 35, in order to assure an axial displacement of the valve piston 3 when the maximum pressure is exceeded. At the level of the gap which is thus present between valve piston 3 and threaded body 35, the relief bore 14, which likewise leads to the oil reservoir 13, is positioned.

Figure 6:
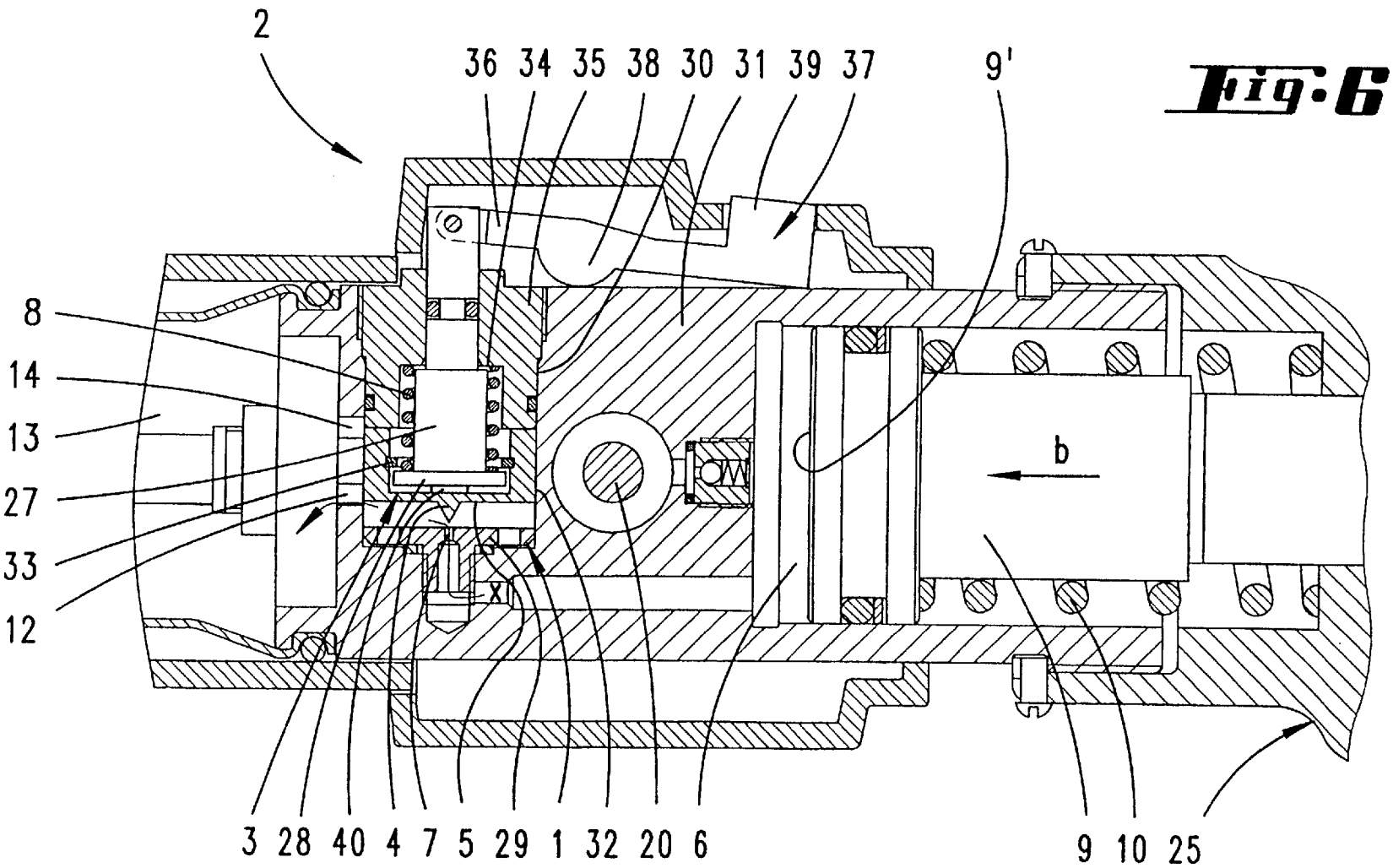
FIG. 6 shows a sectional view corresponding to FIG. 5, but in the course of the return stroke of the hydraulic piston of the device.

As in the manner detailed with reference to the exemplary embodiment previously described, when a predefined maximum pressure in the pressure space 6 is exceeded, the valve piston 3 is lifted against the force of the compression spring 8, upon which the discharge port 12 is opened for return flow of the oil into the oil reservoir 13. Because of the resulting pressure drop, the hydraulic piston 9 is displaced back again into its initial position by the agency of its return spring 10 (arrow d in FIG. 6).

When there is a drop in pressure below the limiting value defined by the piston surface area 5 and by the force of the compression spring 8, the valve piston 3 falls back automatically into its initial, closed position.

Furthermore, the valve piston 3 which is formed to be pot-shaped can be lifted by means of the outwardly extending pulling part 27, by way of the actuation rocker 37, by pressing on the actuation key 39. In this way, a manual return stroke of the hydraulic piston 9, required in emergencies, is ensured at all times.

The threaded body 35 serves further for setting the desired preloading of the compression spring, and thus for adjusting the limiting pressure.

An alternative embodiment of the return valve 1 is illustrated in FIG. 7. In contrast to the previously described embodiment, the valve piston 3 of the return valve 1 is formed not to be pot-shaped but rather as a hollow cylinder with substantially constant thickness of the pot wall 32. The valve piston 3 thus formed is penetrated by the pulling part 27, aligned axially with respect to the piston 3, the plate-like drive head 28 of the pulling part 27 being gripped from behind by a radial collar 40 of the valve piston 3, which forms a drive nose. The collar 40 projects from the pot wall 32 into the interior of the valve piston 3, the radial extent of this collar 40 being dimensioned such as to effect at the same time a centering of the pulling part 27.

Considered in the axial direction of the valve piston 3, the radial collar 40 is offset from the piston surface 5 by the magnitude of the thickness of the drive head.

The compression spring 8 which encircles the pulling part 27 is supported at one of its ends on the base 34 of the threaded body 35 and, at its other end, on the rear face of the radial collar 40 of the valve piston 3, for engaging the valve piston 3 and also, through the radial collar 40, for engaging the pulling part 27 in the closed position of the valve.

By the described arrangement of the radial collar 40, the drive head 28 of the pulling part 27 is set into the piston surface 5 of the valve piston 3. The drive head 28 thus forms, in the open condition of the return valve 1, a partial piston surface 41 integrated into the piston surface 5. At the centre of this partial piston surface 41, the needle point 4 is formed, which in the closed position closes off the bore 7 of the return valve 1 and accordingly is now a component of the pulling part 27. This needle point 4, in cooperation with the bore 7 in the closed condition, defines a partial piston surface, the area of which is calculated with reference to the desired maximum pressure.

To the rear of the total valve piston surface formed by the piston surface 5 and by the partial piston surface 41 of the pulling part 27, there is provided an annular groove 42, open to the outer surface of the pot; in the exemplary embodiment of FIG. 7, this groove is formed in the outer wall 32 of the pot. This annular groove 42 is radially outwardly closed off by the bore wall of the pump cylinder 31. Only in the region of the discharge port 12 is there an overlap, in the closed condition of the return valve 1, so that the annular groove 42 communicates with this discharge port 12 by way of a gap 43 created by the overlap.

The distance b from the annular groove 42 to the piston surface 5 is for this reason greater than the diameter c of the discharge port 12. It follows from this that, in the closed condition of the return valve 1, a closed periphery of the valve piston 3 closes the discharge port 12 off from the gap formed between piston surface 5 and seating disc 29.

The annular groove 42 communicates with the valve piston surface 5 through an axially aligned through passage 44. The diameter of this through passage 44 is here kept small. In the exemplary embodiment shown, the diameter of the through passage corresponds to about half the diameter of the oil inlet bore 7.

An opposite disposition of the through passage bore 44 relative to the discharge port 12 is preferred, moreover.

When a predefined maximum pressure in the pressure space 6 is exceeded, the drive head 28 of the pulling part 27 is lifted up and, by it, the valve piston 3 is lifted up against the force of the compression spring 8, whereupon the discharge port 12 is opened for return of the oil into the oil reservoir 13. At the same time the annular groove 42 is moved out of the region of the outlet port 12 by this upward displacement of the valve piston 3, giving a complete radial closing off of this annular groove 42.

The through passage 44 mentioned serves in stationary closed operation to allow unavoidable oil residues to drain off into the annular groove 42, which residues can flow away through the discharge port 12 by way of the gap 42 provided, and this without the occurrence of a rise in pressure in the remaining gap between piston surface 5 and seating disc 29. The through passage 44 is nevertheless kept so small that when the return valve 1 is opened, the valve piston 3 is displaced smoothly into the open position, since the oil which then enters the intermediate space between piston surface 5 and seating disc 29, on account of the quantity thereof, likewise leads to a closing off of the through passage 44. The through passage 44, as a result, has no disadvantageous effect on the opening properties of the valve.

When there is a drop in pressure below the limiting value defined by the piston surface 5 and the partial piston surface 41 of the drive head 28 and defined by the force of the compression spring 8, the valve piston 3 falls automatically back into its initial closed position, and residues between piston surface 5 and seating disc 29 are conducted by way of the through passage 44 into the annular groove 42, which leads to a faster pressure drop and thus to a faster closure of the valve. The oil residue collected in the annular groove 42, in the closed condition according to FIG. 7, can drain off into the oil reservoir 13 through the gap 43 by way of the discharge port 12.

An alternative arrangement to the embodiment previously described is illustrated in FIG. 8. Here the annular groove 42 is provided in the cylinder bore 30 of the pump cylinder 31 at the level of the discharge port 12, and the height of the annular groove corresponds to the diameter of the discharge port.

The through passage 44 opens, in this exemplary embodiment, into a radial bore 45 of the valve piston 3. This is at a distance b from the piston surface 5, and dimension b is again chosen to be greater than the diameter c of the discharge port 12. For this reason, the radial bore 45 is for the most part covered over radially by the bore wall of the pump cylinder 31, except for a gap 43 to the annular groove 42, by way of which gap 43 oil residues can drain away.

This radial bore 45 is also preferably disposed oppositely located relative to the discharge port 12.

The mode of operation of the return valve 1 illustrated in FIG. 8 corresponds to the embodiment described with reference to FIG. 7, in that in both embodiments a hand-actuated displacement of the valve piston 3 by way of the pulling part 37 can also take place. For this purpose, there is provided an actuation rocker 37, pivotable about a pivot pin 46 or the like mounted on the pump cylinder and having an arm 36, one end of which acts on the pulling part 27.

The return valve 1 employed in the previously described embodiments can find application in addition in hand or foot-operated pressing tools.

All features disclosed are pertinent to the invention. The disclosure content of the associated/attached priority documents (copy of the prior application) is hereby incorporated in its entirety in the disclosure of the application, for the additional purpose of incorporating features of these documents in claims of the present application.

What is claimed is:

1. Hydraulic pressing device (2) comprising a stationary part (26) and a moving part (24), an inlet valve, an actuatable return valve (1) having an open position and a closed position, a return spring (10), and a hydraulic piston (9), the moving part (24) being moved relative to the stationary part (26) by means of the hydraulic piston (9) acted on by oil under pressure and being movable during a return stroke back into an initial position by means of the return spring (10), wherein the return stroke starts in dependence on a predetermined pressing pressure by actuation of the return valve (1), wherein the automatically actuating return valve (1) is maintained in the open position until the return stroke of the hydraulic piston (9) has been completed by the pressure of the oil during the return stroke.

2. Pressing device according to claim 1, wherein the return valve (1) is formed as a valve piston (3) having a partial piston surface area which is effective in the closed condition and is configured with reference to a desired maximum pressure.

3. Pressing device according to claim 2, further comprising a compression spring (8) and a cylinder (11), the return valve (1) being biased into the closed position by means of the compression spring (8), said valve piston (3) being accommodated in the cylinder (11), said cylinder (11) including a discharge port (12) to an oil reservoir (13), wherein the discharge port (12) is configured to open in the course of movement of the valve piston (3) into the open position.

4. Pressing device according to claim 1, wherein the return valve (1) is formed as a valve piston (3), said pressing device further comprising a cylinder having a wall, wherein a relief bore (14) penetrates the cylinder wall and is provided at a rear portion of the valve piston (3).

5. Pressing device according to claim 3, wherein the return valve (1) is formed as a valve piston (3), wherein the valve piston (3) is movable into the open position by manual actuation.

6. Pressing device according to claim 1, wherein the return valve (1) is formed as a valve piston (3), said pressing device further comprising a pulling part (27) and a cylinder (11), wherein said pulling part (27) is connected to the valve piston (3) and passes through the cylinder (11).

7. Pressing device according to claim 6, further comprising an actuating rocker (37), wherein said pulling part (27) is moveable manually by means of the actuating rocker (37).

8. Pressing device according to claim 1, wherein the return valve (1) is formed as a valve piston (3) having a pressure face, wherein the valve piston (3), rearwardly of its pressure face, is generally pot-shaped.

9. Pressing device according to claim 1, wherein the return valve (1) is formed as a valve piston (3) having a drive nose, said pressing device further comprising a pulling part (27), said pulling part (27) comprising a drive head (28) wherein said drive head (28) stands in engagement with the drive nose of the valve piston (3).

10. Pressing device according to claim 1, wherein the return valve (1) is formed as a valve piston (3), said pressing device further comprising a compression spring (8) and a pulling part (27), wherein the compression spring (8) acts on the valve piston (3) by way of the pulling part (27).

11. Pressing device according to claim 1, wherein the return valve (1) is formed as a valve piston (3) having a pot wall (32) and a drive nose, wherein the drive nose is an expanding ring (33) which is disposed in the pot wall (32) of the valve piston (3).

12. Pressing device according to claim 1, wherein the return valve (1) is formed as a valve piston (3) having a pot wall (32) and a drive nose, wherein the drive nose is a radial collar (40) formed in the pot wall (32) of the valve piston (3), said pressing device further comprising a pulling part (27), wherein the collar (40) is configured to generally center the pulling part (27) in the valve piston (3).

13. Pressing device according to claim 1, said pressing device further comprising a cylindrical pulling part (27), said cylindrical pulling part (27) including a drive head (28) formed as a circumferential flange on the cylindrical pulling part (27).

14. Pressing device according to claim 1, wherein the return valve (1) is formed as a valve piston (3), said pressing device further comprising a pulling part (27) having a spigot portion (40) of reduced diameter and a drive head (28), wherein the pulling part (27) acts upon the valve piston (3) by way of the spigot portion (40), wherein the spigot portion (40) is centrally disposed on the drive head (28).

15. Pressing device according to claim 1, said pressing device further comprising a pulling part (27) having a drive head (28), wherein the drive head (28) defines an active piston surface when the return valve (1) is in the open position.

16. Pressing device according to claim 1, wherein the return valve (1) is formed as a valve piston (3) having an active valve piston surface (5), said pressing device further comprising a pulling part (27) having a drive head (28), wherein the drive head (28), when the return valve (1) is in the open position, defines a partial piston surface (41) integrated with the active valve piston surface (5) of the valve piston (3).

17. Pressing device according to claim 1, further comprising a pulling part (27) having a drive head (28), wherein the drive head (28), in the closed condition, defines a partial piston surface area which is configured with reference to a desired maximum pressure.

18. Pressing device according to claim 1, wherein the return valve (1) is formed as a valve piston (3) having a closed circumference, said closed circumference having a height (b), said pressing device further comprising a cylinder (11) which includes a discharge port (12) to an oil reservoir (13), said discharge port (12) having a diameter (c), wherein the diameter (c) of the discharge port (12) is smaller than the height (b) of a closed circumference of the valve piston (3).

19. Pressing device according to claim 3, wherein the return valve (1) is formed as a valve piston (3) having a valve piston surface (5) and an outer sleeve, wherein an annular groove (42) open to the outer sleeve of the valve piston (3) is provided rearwardly of the valve piston surface (5).

20. Pressing device according to claim 19, wherein the return valve (1) is formed as a valve piston (3) having a valve piston surface (5), said pressing device further comprising a cylinder (11) which includes a discharge port (12) to an oil reservoir (13), said discharge port (12) having a diameter (c), wherein a distance between the valve piston surface (5) and the annular groove (42) is greater than the diameter (c) of the discharge port (12).

21. Pressing device according to claim 20, wherein an axially aligned through passage (44) extends from the valve piston surface (5) for connecting the valve piston surface (5) with the annular groove (42).

22. Pressing device according to claim 21, wherein the valve (1) has an oil inlet bore (7), and the oil inlet bore (7) has a diameter, said through passage (44) having a diameter, wherein the diameter of the through passage (44) is smaller than the diameter of an oil inlet bore (7) of the valve (1).

23. Pressing device according to claim 1, wherein the return valve (1) is formed as a valve piston (3) having a valve piston surface (5) and an outer wall (32), said pressing device further comprising a cylinder (11) having a cylinder bore (30), wherein an annular groove (42) is provided in the outer wall (32) of the valve piston (3), for a substantially horizontal disposition of the cylinder bore (30).

24. Pressing device according to claim 23, wherein the annular groove (42) is provided in the cylinder bore (30) and the valve piston (3) has an associated radial bore (45).

* * * * *

UNITED STATES PATENT AND TRADEMARK OFFICE

CERTIFICATE OF CORRECTION

PATENT NO. : 6,276,186 B1
DATED : August 21, 2001
INVENTOR(S) : Egbert Frenken

It is certified that error appears in the above-identified patent and that said Letters Patent is hereby corrected as shown below:

Title page,
Item [57], ABSTRACT,
Line 3, "the moving past (24)" should read -- the moving part (24) --

Signed and Sealed this

Ninth Day of September, 2003

JAMES E. ROGAN
*Director of the United States Patent and Trademark Office*